US012686937B2

(12) United States Patent
Rabe et al.

(10) Patent No.: US 12,686,937 B2
(45) Date of Patent: Jul. 21, 2026

(54) ELECTRODEPOSITION OF MOLYBDENUM DISULFIDE DRY FILM LUBRICANT COATINGS

(71) Applicant: GM Global Technology Operations LLC, Detroit, MI (US)

(72) Inventors: Adam Paul Rabe, Auburn Hills, MI (US); Jacob Alexander Rabe, Auburn Hills, MI (US); Matthew G. Keast, Clawson, MI (US); Zhe Li, Rochester, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 521 days.

(21) Appl. No.: 18/354,298

(22) Filed: Jul. 18, 2023

(65) Prior Publication Data

US 2025/0027223 A1 Jan. 23, 2025

(51) Int. Cl.

| | |
|---|---|
| ***C25D 9/06*** | (2006.01) |
| ***C25D 7/10*** | (2006.01) |
| ***C25D 21/12*** | (2006.01) |

(52) U.S. Cl.

CPC ..... *C25D 9/06* (2013.01); *C25D 7/10* (2013.01); *C25D 21/12* (2013.01)

(58) Field of Classification Search

None

See application file for complete search history.

(56) References Cited

U.S. PATENT DOCUMENTS 2,902,417 A * 9/1959 Ingraham ..... H01F 1/0315 148/246
3,591,472 A * 7/1971 Amsallem ..... C01G 1/12 205/101

FOREIGN PATENT DOCUMENTS

GB 1313510 A * 4/1973 ..... B21B 45/0245

OTHER PUBLICATIONS

Everett, Hayley, Preventing electrical erosion of bearings in EV drivetrains, Engineer Live, <<https://www.engineerlive.com/content/preventing-electrical-erosion-bearings-ev-drivetrains >> Dec. 5, 2022.
Harutyunyan, Vladimir, Electric Motor Bearing Types and Characteristics, HVH Industrial. <<https://hvhindustrial.com/blog/electric-motor-bearing-types-and-characteristics>> (accessed Jul. 4, 2023).

(Continued)

*Primary Examiner* — Brian W Cohen

(74) *Attorney, Agent, or Firm* — Vivacqua Crane, PLLC

(57) ABSTRACT

A method of forming a lubricant coating, a method of coating a bearing surface with a lubricant coating, and a vehicle including a bearing including a lubricant coating. A substrate, such as a bearing, including a surface and an electrode are immersed in an electrolyte bath. The electrolyte bath includes an aqueous electrolyte solution including sodium metabisulfite ($Na_2S_2O_5$), sodium molybdate ($Na_2MoO_4 \cdot 2H_2O$), a pH modifier, an anionic surfactant, and water. A first pulsed direct current is applied through the aqueous electrolyte solution using a direct current power supply and a molybdenum disulfide ($MoS_2$) layer is formed on the surface of the substrate.

20 Claims, 5 Drawing Sheets

(56) References Cited

OTHER PUBLICATIONS

Lee, Paul, Mind the BandGap—It's Gotten Wider!, Mouser Electronics, << https://www.mouser.com/applications/mind-wider-bandgap/ >> Mar. 6, 2020.
Roman, Matthew, Bearing damage . . . a lurking problem in electric cars, Vehicle Service Pros, <<https://www.vehicleservicepros.com/collision-repair/on-the-shop-floor/article/21180653/bearing-damagea-lurking-problem-in-electric-cars >> Dec. 31, 2019.
Sexton, Brian, Understanding EV Wheel Hub Bearings, Brake & Front End, Transtar Industries, <<https://www.brakeandfrontend.com/understanding-ev-wheel-hub-bearings/>> Apr. 18, 2022.
Wikipedia Contributors, Electric motor, Wikipedia, The Free Encyclopedia, Jul. 7, 2023, version ID 1163998184.
Zhang, Min, Demystifying EMC in an Electric Vehicle's Drive Unit, Interference Technology, <<https://interferencetechnology.com/demystifying-emc-in-an-electric-vehicles-drive-unit/>> Jul. 16, 2020.

* cited by examiner $$SO_3^{2-}{}_{(aq)} + 6H^+ + 2e^- \rightarrow S_{(aq)}^{2-} + 3H_2O$$

$$MoO_4^{2-}{}_{(aq)} + 6S_{(aq)}^{2-} + 12H^+ \rightarrow MoS_4^{2-}{}_{(aq)} + 4H_2O + 2H_2S$$

$$MoS_4^{2-}{}_{(aq)} + 6H^+ + 2e \rightarrow MoS_{2(s)} + 2H_2S_{(g)} + H_{2(g)}$$

FIG. 3

$$2Fe_{(s)} \rightarrow 4e^- + 2Fe^{2+}$$

$$2Fe^{2+}{}_{(aq)} + 4OH^- \rightarrow 2Fe(OH)_{2(s)}$$

$$2Fe(OH)_{2(s)} + O_{2(g)} \rightarrow Fe_2O_{3(s)}$$

FIG. 4

ELECTRODEPOSITION OF MOLYBDENUM DISULFIDE DRY FILM LUBRICANT COATINGS

BACKGROUND

Many electric vehicles, including battery electric vehicles, plug-in hybrid electric vehicles, and hybrid electric vehicles, are propelled by a drive unit that includes an electric motor, a power electronics module, and a transmission. Electric motors sometimes include alternating current, three-phase traction motors. However, batteries provide direct current, which is converted to alternating current using an inverter in the power electronic module. The inverter may induce a voltage on the motor shaft and create a parasitic current in the motor bearings. The motor bearings can be comprised of inner and outer bearing raceways and cylindrical or spherical rolling elements. The lubrication fluid film which surrounds the bearing elements may function as an insulator, provided the breakdown voltage of the lubricant is not exceeded. If the lubricant breakdown voltage is exceeded, the hydrodynamic lubrication fluid film is compromised, or arcing happens between the interfaces, pitting in the bearing cages and/balls may happen as a result, which may and shorten the life of the bearing.

While current lubricating materials achieve their intended purpose, room remains for development of lubricant coatings and the method of applying such lubricant coatings on substrates, particularly for motor bearing applications.

SUMMARY

Accordingly to various aspects, the present disclosure relates to a method of forming a lubricant coating. The method includes immersing a substrate including a surface and an electrode in an electrolyte bath. The electrolyte bath includes an aqueous electrolyte solution including sodium metabisulfite ($Na_2S_2O_5$), sodium molybdate ($Na_2MoO_4 \cdot 2H_2O$), a pH modifier, an anionic surfactant, and water. The method further includes applying a first pulsed direct current through the aqueous electrolyte solution using a first direct current power supply and forming a molybdenum disulfide ($MoS_2$) layer on the surface of the substrate. The polarity of the first pulsed direct current causes the substrate to provide an anode and the electrode to provide a cathode.

In embodiments of the above, the first pulsed direct current is applied at a peak density in the range of 5 milliamps per square centimeter (mA/cm^2) to 50 mA/cm^2 for a time period of 5 minutes to twenty minutes, wherein the pulses cycle in the range of 1 second to 4 second and have a duty cycle in the range of 25 percent to 50 percent of the cycle.

In any of the above embodiments, the method further includes preparing the aqueous electrolyte solution by combining the sodium metabisulfite ($Na_2S_2O_5$) in the range of 5 percent and 15 percent by weight of the total weight of the aqueous electrolyte solution; the sodium molybdate ($Na_2MoO_4 \cdot 2H_2O$) in the range of 3 percent and 10 percent by weight of the total weight of the aqueous electrolyte solution, the pH modifier, and the anionic surfactant with the water.

In embodiments of the above, the method further includes combining the pH modifier to the aqueous electrolyte solution and adjusting the pH of the aqueous electrolyte solution to a pH in the range of 4.0 to 7.0. In further embodiments, citric acid is combined as the pH modifier.

In any of the above embodiments, the method includes combining the anionic surfactant in the range of 5 percent and 15 percent by weight of the total weight of the aqueous electrolyte solution.

In any of the above embodiments, the method further includes applying a second pulsed direct current through the aqueous electrolyte solution. The polarity of the second pulsed direct current causes electrode to provide the anode and the substrate to provide the cathode; and forming a black oxide ($Fe_3O_4$) layer on the surface of the substrate prior to applying the first pulsed direct current. In further embodiments, the second pulsed direct current is applied at a peak density in the range of 5 milliamps per square centimeter (mA/cm^2) to 25 mA/cm^2 for a time period of one minute to five minutes, wherein the pulses cycle in the range of 1 second to 4 seconds and have a duty cycle in the range of 25 percent to 50 percent of the cycle.

In any of the above embodiments, the molybdenum disulfide ($MoS_2$) layer is in the range of 0.01 micrometer and 4 micrometers in thickness and the black oxide ($Fe_3O_4$) layer is in the range of 0.1 micrometer to 3 micrometers in thickness.

In any of the above embodiments, the sodium metabisulfite ($Na_2S_2O_5$) present in the range of 8 and 12 percent by weight of the total weight of the aqueous electrolyte solution, the sodium molybdate ($Na_2MoO_4 \cdot 2H_2O$) present in the range of 3 percent and 7 percent by weight of the total weight of the aqueous electrolyte solution, citric acid as the pH modifier present in the range of 1 percent and 3 percent by weight of the total weight of the aqueous electrolyte solution, TEEPOL 601 S as the anionic surfactant present in the range of 8 percent and 12 percent by weight of the total weight of the solution, and the water.

In any of the above embodiments, immersing the substrate includes immersing at least one surface of a bearing. In further embodiments, the bearing is a ball bearing. In alternative further embodiments, the bearing is a journal bearing.

According to various additional aspects, the present disclosure is directed to a method of coating a bearing surface with a lubricant coating. The method includes immersing a bearing including a surface and an electrode in an electrolyte bath. The electrolyte bath includes an aqueous electrolyte solution including sodium metabisulfite ($Na_2S_2O_5$), sodium molybdate ($Na_2MoO_4 \cdot 2H_2O$), a pH modifier, an anionic surfactant, and water. The method also includes applying a first pulsed direct current through the aqueous electrolyte solution using a direct current power supply and forming a molybdenum disulfide ($MoS_2$) layer on the surface of the bearing. The polarity of the first pulsed direct current causes the bearing to provide an anode and the electrode to provide a cathode.

In embodiments of the above, the first pulsed direct current in the range of 5 milliamps per square centimeter (mA/cm^2) to 50 mA/cm^2 for a time period of 5 minutes to twenty minutes, wherein the pulses cycle in the range of 1 second to 4 second and have a duty cycle in the range of 25 percent to 50 percent of the cycle.

In any of the above embodiments, the method also includes applying a second pulsed direct current through the aqueous electrolyte solution and forming a black oxide ($Fe_3O_4$) layer on the surface of the substrate prior to applying the first pulsed direct current. The polarity of the second pulsed direct current causes electrode to provide the anode and the substrate to provide the cathode. In further embodiments, the second pulsed direct current comprises applying the second pulsed direct current in the range of 5 milliamps per square centimeter (mA/cm^2) to 25 mA/cm^2 for a time period of 1 minute to five minutes, wherein the pulses cycle in the range of 1 second to 4 seconds and have a duty cycle in the range of 25 percent to 50 percent of the cycle.

In any of the above embodiments, the method further includes preparing the aqueous electrolyte solution by combining the sodium metabisulfite ($Na_2S_2O_5$) present in the range of 5 percent and 15 percent by weight of the total weight of the aqueous electrolyte solution, the sodium molybdate ($Na_2MoO_4 \cdot 2H_2O$) present in the range of 3 percent and 10 percent by weight of the total weight of the aqueous electrolyte solution, citric acid as the pH modifier present in the range of 1 percent and 3 percent by weight of the total weight of the aqueous electrolyte solution, TEEPOL 601 S as the anionic surfactant present in the range of 5 percent and 15 percent by weight of the total weight of the solution, and the water.

According to yet several additional aspects, the present disclosure relates to a vehicle. The vehicle includes an electric drive unit including a battery, a power electronic module connected to the battery, an electric motor connected to the power electronic module, and a transmission connected to the electric motor. The power electronic module also includes an inverter. A motor shaft is connected to the electric motor and a bearing, including a surface, rotatably supports the motor shaft. In addition, a coating including a molybdenum disulfide ($MoS_2$) layer is disposed on the surface of the bearing, wherein the molybdenum disulfide ($MoS_2$) layer is in the range of 0.1 micrometer and 4 micrometers in thickness.

In embodiments of the above, the coating further includes a black oxide ($Fe_3O_4$) layer contacting the surface of the bearing and the molybdenum disulfide ($MoS_2$) layer contacts the black oxide ($Fe_3O_4$) layer, wherein the black oxide ($Fe_3O_4$) layer is in the range of 0.1 micrometers to 3 micrometers in thickness.

BRIEF DESCRIPTION OF DRAWINGS

The drawings described herein are for illustration purposes only and are not intended to limit the scope of the present disclosure in any way.

FIG. 3 illustrates reaction mechanisms for forming one or more molybdenum disulfide ($MoS_2$) layers on the substrate, according to embodiments of the present disclosure.

FIG. 4 illustrates reaction mechanisms for forming one or more black oxide layers on the substrate, according to embodiments of the present disclosure.

DETAILED DESCRIPTION

Figure 1:
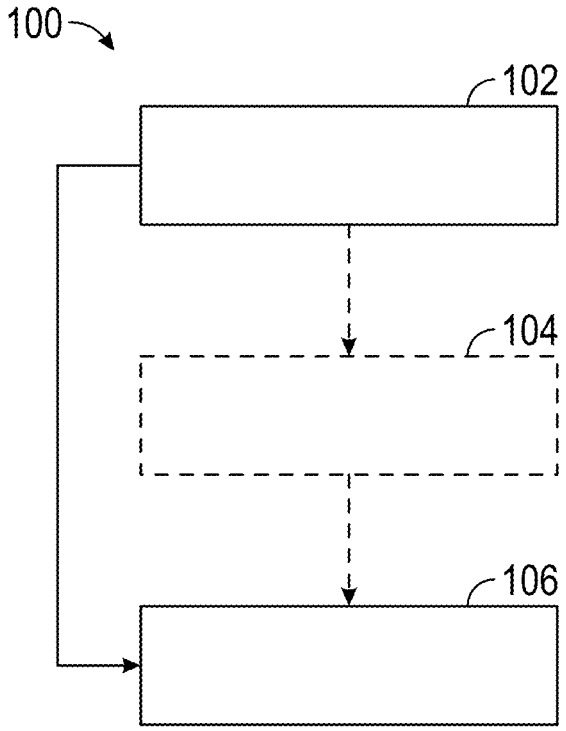
FIG. 1 illustrates a method of electrolytic deposition of a coating including a molybdenum disulfide ($MoS_2$) layer and, optionally, a black oxide layer, according to embodiments of the present disclosure.

The following description is merely exemplary in nature and is not intended to limit the present disclosure, application, or uses. Furthermore, there is no intention to be bound by any expressed or implied theory presented in the preceding introduction, summary, or the following detailed description. It should be understood that throughout the drawings, corresponding reference numerals indicate like or corresponding parts and features.

In the claims and specification, certain elements are designated as "first," "second," "third," "fourth," "fifth," "sixth," and "seventh." These are arbitrary designations intended to be consistent only in the section in which they appear, i.e. the specification or the claims or the summary, and are not necessarily consistent between the specification, the claims, and the summary. In that sense they are not intended to limit the elements in any way and a "second" element labeled as such in the claim may or may not refer to a "second" element labeled as such in the specification. Instead, the elements are distinguishable by their disposition, description, connections, and function.

As used herein, the term "vehicle" is not limited to automobiles. While the present technology is described primarily herein in connection with motor bearings used in conjunction with electric vehicles, the technology is not limited to electric vehicles or motor bearings. The concepts can be used in a wide variety of applications, such as in connection with components used in motorcycles, mopeds, locomotives, aircraft, marine craft, and other vehicles, as well as in other applications incorporating hydrogen fuel cells and in applications incorporating electric motors. Applications include, for example, components industrial machines and motors, agricultural equipment, compressors, defense equipment, HVAC (heating, ventilation, and air conditioning) systems, residential and commercial power generators, and pumps, where lubrication of the component is desirable.

Reference will now be made in detail to several examples of the disclosure that are illustrated in accompanying drawings. Whenever possible, the same or similar reference numerals are used in the drawings and the description to refer to the same or like parts or steps. The drawings are in simplified form and are not to precise scale.

The present disclosure relates to molybdenum disulfide ($MoS_2$) dry film lubricant coatings and electrodeposition of molybdenum disulfide ($MoS_2$) dry film lubricant coatings. The lubricant coatings include a layer of molybdenum disulfide ($MoS_2$) deposited on the surfaces of bearings used in a vehicle and, in embodiments, motor bearing used to support the motor shaft in the electric drive unit of electric vehicles. The lubricant coating may be understood herein as a coating that reduces the friction exhibiting by the surfaces of the substrate the coating is applied to.

Figure 2:
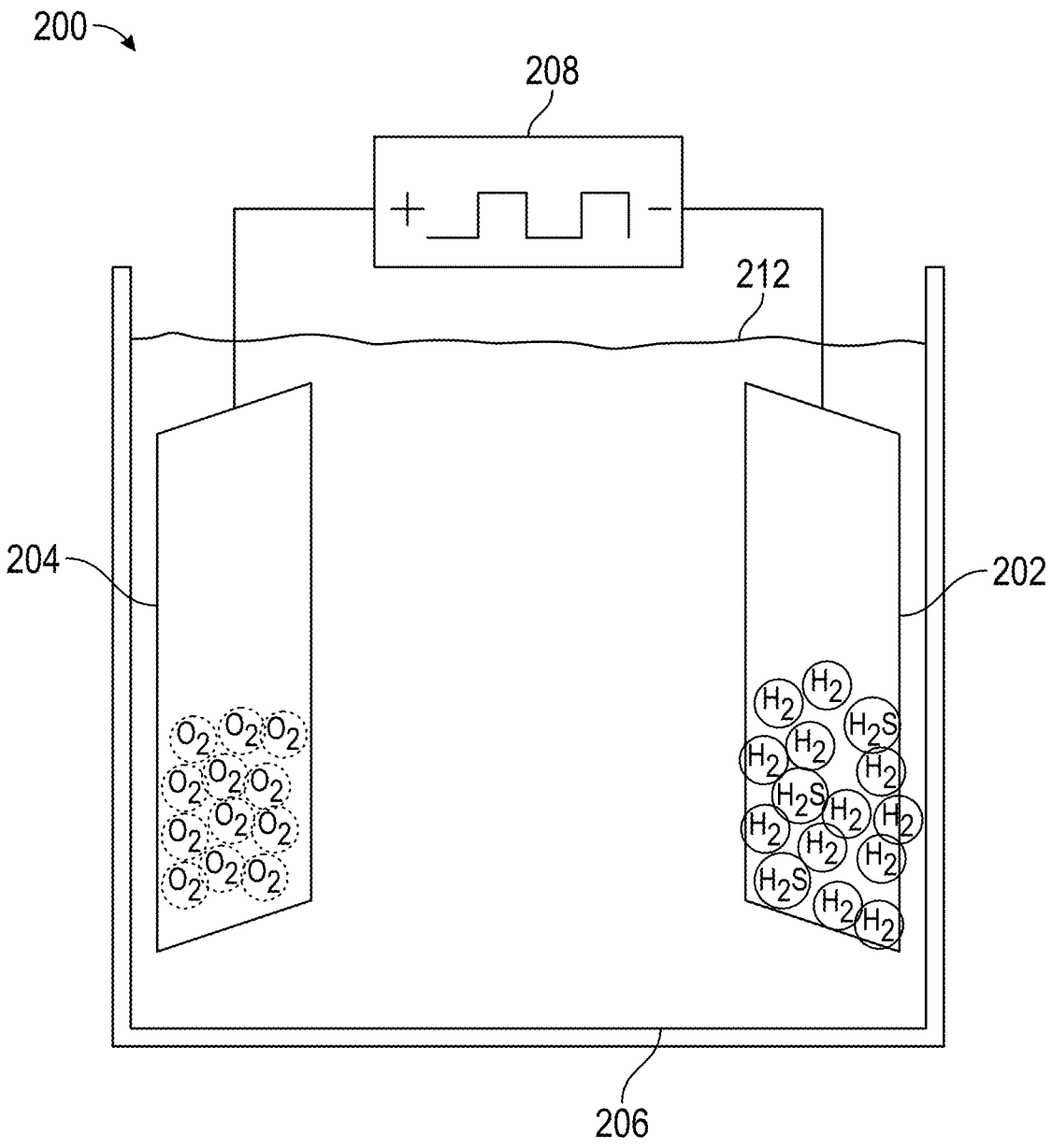
FIG. 2 illustrates a schematic of an electrodeposition cell for applying the layer of molybdenum disulfide ($MoS_2$) and, optionally, the layer of black oxide on the substrate, according to embodiments of the present disclosure.

Reference is made herein to FIGS. 1 and 2 illustrating a method and system for electrodeposition of a molybdenum disulfide ($MoS_2$) layer on a metallic or semi-conductive substrate. In embodiments, a black oxide ($Fe_3O_4$) layer is applied to the substrate prior to coating the substrate with the molybdenum disulfide ($MoS_2$) layer. The substrate constitutes any portion of a bearing, as described further herein, or other component where the application of a dry lubricant may be desirable. Dry film lubricants may be understood as a solid lubricant. In embodiments, the substrate includes at least one of stainless steel, such as 52100 steel, a tin copper alloy, brass, a babbitt alloy such as lead babbitt alloys and tin babbitt alloys, aluminum, and an aluminum alloy.

In embodiments, the method 100 of forming the lubricant coating begins at block 102 with cleaning the substrate. In embodiments, the substrate may be cleaned with an alkaline detergent or a solvent. Examples of suitable alkaline detergents include one or more of tetra potassium pyrophosphate, potassium hydroxide, sodium metasilicate, and sodium tripolyphosphate. Examples of suitable solvents include one or more of a polar protic solvent such as isopropyl alcohol; a polar aprotic solvent such as acetone, ether, and chloroform; ammonia; ammonium hydroxide; calcium hydroxide; calcium oxide; potassium; potassium hydroxide; potassium carbonate; sodium; sodium carbonate; sodium hydroxide; sodium peroxide; sodium silicate; and trisodium phosphate. The surfaces of the substrate may be immersed or otherwise contacted with the detergent or solvent, which may then be removed, or evaporated from (in the case of the solvent), the surfaces of the substrate.

At block 106, the molybdenum disulfide ($MoS_2$) coating may be applied to the substrate 202. With reference to FIG. 2, the substrate 202 is immersed in an electrolyte bath 206 along with an electrode 204. The electrolyte bath 206 may be held at a temperature in the range of 15° C. to 40° C., including all values and ranges therein during the electrodeposition process using heaters applied to the electrolyte bath 206. In embodiments, the electrode 204 is formed of an inert electrode material such as stainless steel or platinized titanium. The inert electrode does not react with aqueous electrolyte solution, even upon the application of current to the solution. A first pulsed direct current is applied through the aqueous electrolyte solution by a direct current power supply 208 connected to the substrate 202 and the electrode 204. The polarity of the current on the substrate 202 and electrode 204 causes the substrate 202 to provide an anode and the electrode 204 to provide a cathode. The pulsed current is applied with a peak current density within the range of 5 milliamps per square centimeter (mA/cm^2) to 50 mA/cm^2, including all values and ranges therein, in 1 second to 4 second cycles having a duty cycle in the range of 25 to 50 percent of the cycle. Accordingly, the current may be applied for 0.25 seconds to 2 seconds, every 1 second to 4 seconds. The current is applied for a first total time period in the range of 5 minutes to 20 minutes, including all values and ranges therein. This results in the deposition of the molybdenum disulfide ($MoS_2$) layer on the surfaces of the substrate 202. In embodiments, the layer is a monolayer of molybdenum disulfide ($MoS_2$) including an ordered plane of molybdenum atoms sandwiched between two planes of sulfide ions.

The electrolyte bath 206 includes an aqueous electrolyte solution 212. The aqueous electrolyte solution 212 is prepared by combining sodium metabisulfite ($Na_2S_2O_5$), sodium molybdate ($Na_2MoO_4 \cdot 2H_2O$), a pH modifier, an anionic surfactant, and water. In embodiments, the aqueous electrolyte solution 212 consists essentially of, or consists of, the sodium metabisulfite ($Na_2S_2O_5$), sodium molybdate ($Na_2MoO_4 \cdot 2H_2O$), a pH modifier, an anionic surfactant, and water. In embodiments, the sodium metabisulfite is present in the range of 5 percent to 15 percent by weight of the total weight of the aqueous electrolyte solution, including all values and ranges therein, and the sodium molybdate is present in the range of 3 percent and 10 percent by weight of the total weight of the aqueous electrolyte solution, including all values and ranges therein. The pH modifier may be added in an amount sufficient to change the pH to a pH in the range of 4.0 to 7.0 including all values and increments therein. In embodiments, the citric acid is present in the range of 1 percent to 3 percent by weight of the total weight of the aqueous electrolyte solution, including all values and ranges therein. In addition, the anionic surfactant is present in the range of 5 percent and 15 percent by weight of the total weight of the aqueous electrolyte solution, including all values and ranges therein. The remainder of the aqueous electrolyte solution, to total 100% by weight, is water. In any of the above embodiments, water may be present in the range of 66 percent by weight to 80 percent by weight, including all values and ranges therein.

In embodiments, the pH modifier includes, for example, at least one of citric acid $HOC(CO2H)(CH_2CO_2H)_2$, ascorbic acid (C6H8O6), acetic acid ($CH_3COOH$), tartaric acid (2,3-dihydroxybutanedioic acid), phosphoric acid ($H_3PO_4$), and sulfuric acid ($H_2SO_4$). In embodiments, the pH modifier includes citric acid. The anionic surfactant includes for example, at least one of: TEEPOL 610 S (available from Sigma Aldrich); 6-chloro-4-oxo-1,4-dihydro-2-quinazolinecarboxylic acid; sodium lauryl sulfate; sodium dodecyl sulfate; sodium laureth sulfate; phosphoric acid tris(1,3-dichloro-2-propyl-$d_5$ ester); and N-Di[(R)-1-phenylethyl]-[(S)-1,1'-spirobiindane-7,7'-diyl]-phosphoramidite. In any of the above embodiments, the anionic surfactant includes TEEPOL 610 S.

In an embodiment of the above, the aqueous electrolyte solution 212 includes sodium metabisulfite present at 8 percent and 12 percent by weight of the aqueous electrolyte solution, including all values and ranges therein such as 10 percent, sodium molybdate present at 3 percent and 7 percent by weight of the aqueous electrolyte solution, including all values and ranges therein such as 5 percent, citric acid present in the range of 1 percent to 3 percent by weight of the aqueous electrolyte solution, including all values and ranges therein, the anionic surfactant present at 8 percent and 12 percent by weight of the aqueous electrolyte solution, including all values and ranges therein, and the remainder being water present at 72 percent by weight of the aqueous electrolyte solution to total 100% by weight. The anionic surfactant being TEEPOL 610 S.

Without being bound to any particular theory, FIG. 3 illustrates an embodiment of the reaction mechanisms in forming the molybdenum disulfide ($MoS_2$) layer on the surfaces of the substrate 202 using the aqueous electrolyte solution 212 illustrated in FIG. 2 and described above.

In optional embodiments of the above where the substrate 202 includes steel or iron, an iron oxide layer of $Fe_3O_4$ (commonly referred to as black oxide or magnetite) is applied prior to applying the molybdenum disulfide ($MoS_2$) at block 104. Iron oxide ($Fe_3O_4$) may also be found as a mixture of FeO and $Fe_2O_3$. The substrate 202 is immersed in the electrolyte bath 206 along with the electrode 204. The electrolyte bath 206 includes the aqueous electrolyte solution 212 according to the embodiments described above. It should be appreciated that it is not necessary to transfer the substrate 202 to a separate electrolyte bath 206 to form the molybdenum disulfide ($MoS_2$) layer as both the black oxide ($Fe_3O_4$) layer and the molybdenum disulfide ($MoS_2$) layer may be applied in the same electrolyte bath 206.

The polarity on the electrodes, i.e., the substrate 202 and the electrode 204, is reversed (causing the substrate 202 to provide the cathode and the electrode 204 to provide the anode), and a second pulsed direct current is applied for a time period in the range of 1 minute to 5 minutes. The pulsed current applied is in the range of 5 mA/cm^2 to 25 mA/cm^2, including all values and ranges therein, in 1 second to 4 second cycles having a duty cycle in the range of 25 to 50 percent. Accordingly, the current may be applied for 0.25 seconds to 2 seconds, every 1 second to 4 seconds. A layer of black oxide ($Fe_3O_4$) is deposited on the surface of the substrate 202 and then the molybdenum disulfide ($MoS_2$) layer is applied to the black oxide ($Fe_3O_4$) layer at block 106. Prior to applying the molybdenum disulfide ($MoS_2$) layer, the polarity to the electrodes is returned so that the substrate 202 is the anode and the electrode 204 becomes the cathode as described above with respect to block 106. Without being bound to any particular theory, FIG. 4 illustrates the reaction mechanisms for depositing the black oxide ($Fe_3O_4$) layer on the substrate 202.

Figure 5:
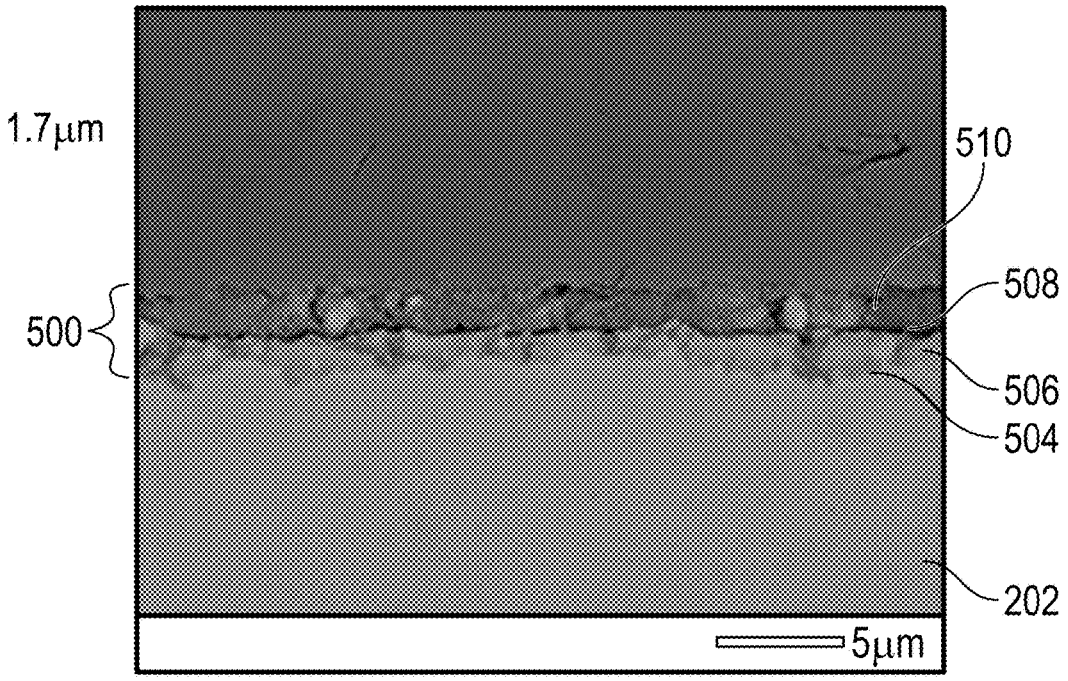
FIG. 5 illustrates a backscattered electron detector scanning electron microscope image of a molybdenum disulfide ($MoS_2$) and black oxide ($Fe_3O_4$) coating on a substrate, according to embodiments of the present disclosure.

As illustrated in FIG. 5, a backscattered electron detector scanning electron microscopy image of a lubricant coating 500 and substrate 202 produced according to the method 100 and system 200 described in FIGS. 1 and 2, a molybdenum disulfide ($MoS_2$) layer 508, and in embodiments, a black oxide ($Fe_3O_4$) layer 506 is formed between the molybdenum disulfide ($MoS_2$) layer 508 and the surface 502 of the substrate 202. Stated another way, when present, the black oxide ($Fe_3O_4$) layer 506 is formed on the surface 504 of the substrate 202, and the molybdenum disulfide ($MoS_2$) layer 510 is formed on the surface 508 of the black oxide ($Fe_3O_4$) layer 506. In embodiments where the black oxide ($Fe_3O_4$) layer 506 is omitted, the molybdenum disulfide ($MoS_2$) layer 510 is formed on the surface 508 of the substrate 202. Both the molybdenum disulfide ($MoS_2$) layer 510 and black oxide ($Fe_3O_4$) layer 506, when present, provide a lubricant coating on the surface 502 of the substrate 202. The molybdenum disulfide ($MoS_2$) layer 510 also provides a direct band gap of about 1.8 eV. The band gap of a substance is understood as the distance between the valance band of electrons and the conduction band of the electrons. Thus, the molybdenum disulfide ($MoS_2$) layer 510 provides a degree of insulation until sufficient energy (or parasitic current) is applied to excite electrons in the valence band to become free and participate in conduction in the conduction band. Accordingly, the molybdenum disulfide ($MoS_2$) layer 510 of the lubricant coating 500 provides a semi-conductor that may assist in reducing damage caused by parasitic current generated by, for example, electric vehicle (EV) drive units, as described further herein. In addition, due to the band gap, the lubricant coating 500 may reflect light having a wavelength of greater than 688 nm in the visible electromagnetic range.

In embodiments, the thickness of the lubricant coating 500 is in the range of 2 micrometer to 7 micrometers, including all values and ranges therein. The molybdenum disulfide ($MoS_2$) layer 510 exhibits a thickness in the range of 0.1 micrometers to 4 micrometers, including all values and ranges therein. When present, the black oxide ($Fe_3O_4$) layer 506 exhibits a thickness in the range of 0.1 micrometer to 3 micrometers, including all values and ranges therein. In addition, in embodiments, the lubricant coating 500 is fully adhered to the substrate surface, as determined by performing tape adhesion testing per ASTM D3359-22, as well as scratch testing and wear testing. No delamination, gross spalling or chipping, or any other method of adhesive failure of the lubricant coating 500 was observed after performing scratch testing and ball-on-disk mini-traction machine (MTM) wear testing using a 3 mm fixed ball-on-disc test at 50 N load at 100 degrees Celsius for a 16 hour run time.

Figure 6A:
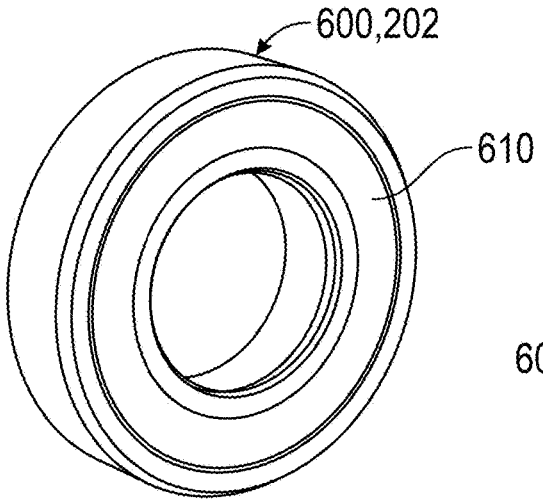
FIG. 6A illustrates a bearing including surfaces on which the molybdenum disulfide ($MoS_2$) lubricant coating may be applied, according to embodiments of the present disclosure.
Figure 6B:
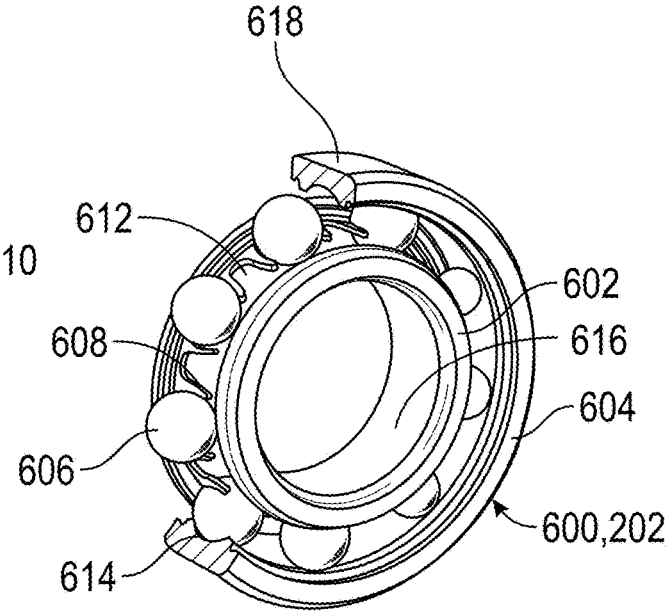
FIG. 6B illustrates a cut-away of the bearing of FIG. 6A, according to embodiments of the present disclosure.

FIGS. 6A and 6B illustrate an embodiment of a bearing 600 used as a substrate 202 in the method 100 and system 200 described above. While a ball bearing 600 is illustrated, the bearing 600 may be a ball bearing including one of a deep groove bearing, angular contact bearing, self-aligning bearing, and thrust ball bearing; a roller bearing including one of a tapered roller bearing, spherical roller bearing, needle bearing, and cylindrical roller bearing; a journal bearing; and a linear motion bearing including slide bearings. The bearing 600 includes one or more bearing surfaces, which contact other moving components, such as a motor shaft, as described further herein.

As illustrated in FIGS. 6A and 6B, the ball bearing 600 includes an inner race 602, an outer race 604, roller balls 606, a cage 608 and, optionally, a shield 610. The inner race 602 includes an inner bearing surface 612 and the outer race 604 includes an outer bearing surface 614, which capture the roller balls 606 with the cage 608. The lubricant coating 500 may be applied to at least one of the surfaces of the bearing 600, and in further embodiments all of the bearing 600 surfaces, including the exterior surfaces 616, 618 of the inner race 602 and outer race 604, respectively, the inner bearing surface 612, the outer bearing surface 614, and the roller balls 606, as well as, optionally, the cage 608. The bearing 600 may also include a liquid lubricant such as grease or lubricating oil. In the illustrated aspect, the liquid lubricant is retained between the inner bearing surface 612 and the outer bearing surface 614, such as with shields 610, connected to one or both sides of the bearing (only a single shield 610 is visible in FIG. 6A). As mentioned above, the use of the lubricant coating 500 provides lubrication in addition to the liquid lubricant, particularly when the hydrodynamic lubricating film is compromised which may occur during start-stop of bearing motion and at higher loads. In addition, the black oxide ($Fe_3O_4$) layer 506 has oleophilic properties which also promotes the formation of a hydrodynamic lubricant film between bearing components. It should be appreciated, however, that there are applications where an additional lubricant is not utilized.

Figure 7:
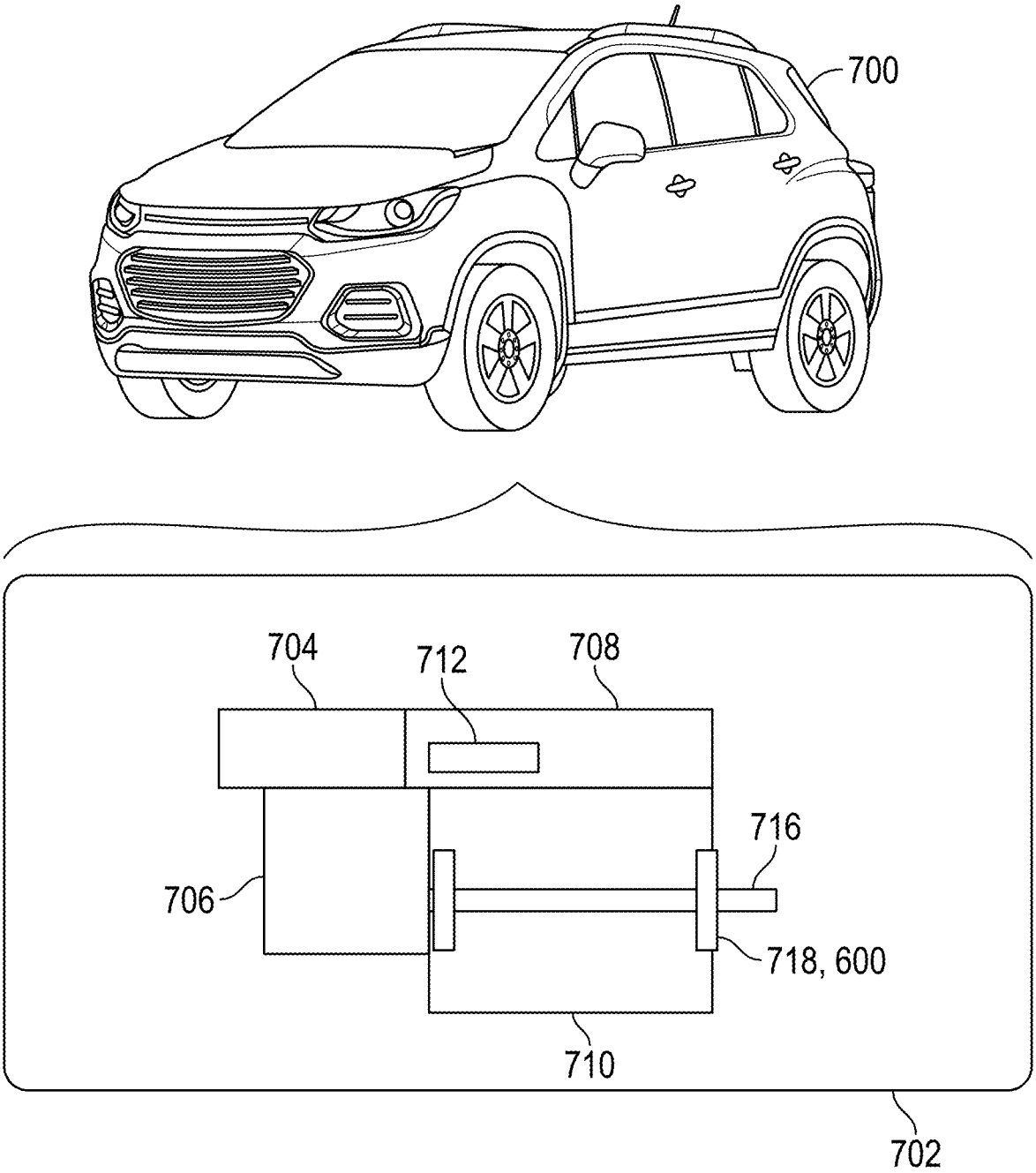
FIG. 7 illustrates a vehicle including an electric drive unit, according to embodiments of the present disclosure.

FIG. 7 illustrates an electric vehicle (EV) 700 including an electric drive unit 702 that incorporates a motor bearing 600. The electric vehicle 700 may be a battery electric vehicle, plug-in hybrid electric vehicle, or a hybrid electric vehicle. In embodiments, the electric drive unit 702 may include one or more batteries 704, one or more power electronics modules 708 connected to the one or more batteries 704, one or more electric motors 706 connected to one or more power electronics modules 708, a motor shaft 716 connected to the one or more one or more electric motors 706, and a transmission 710 connected to the motor shaft 716. The one or more batteries 704 may include, but are not limited to, at least one of a lithium ion battery, a nickel-metal hydride battery, and a solid-state battery. The electric motors 706 may include an alternating current, 3-phase traction motors. However, as batteries provide direct current, the direct current must be converted to alternating current using an inverter 712 included in the power electronic module 708. The inverter 712 may induce a voltage on the motor shaft 716 and create a parasitic current in one or more motor bearings 600, 718 supporting the motor shaft 716. The lubricant, present in the bearing 600, 718 may also function as an insulator, provided the breakdown voltage of the lubricant is not exceeded. The addition of the lubricant coating 500 provides another insulating layer to protect the motor bearings 600, 718 from parasitic current. The lubricant coating 500 also promotes the formation of the hydrodynamic lubricant film which increases the minimum breakdown volage at the bearing surface interfaces.

The lubricant coatings of the present disclosure offer several advantages. These advantages include, for example, lubricating bearing surfaces, which may provide wear resistance, particularly in applications where a lubricant, such as grease or lubricating oil, may not be utilized, during start-stop of bearing motion, and at higher bearing loads. Additional advantages include the promotion of formation of a hydrodynamic lubricant film, when lubricant is present in the bearing, which also increases the minimum breakdown volage at the bearing surface interfaces. Further advantages include electrical insulation characteristics provided by the band gap exhibited by the molybdenum disulfide ($MoS_2$) layer in the lubricant coating. Yet further advantages include the formation of both a black oxide ($Fe_3O_4$) layer and a molybdenum disulfide ($MoS_2$) layer in a single aqueous electrolyte bath without having to remove the substrate from the aqueous electrolyte bath between layers.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of forming a lubricant coating, comprising:

immersing a substrate including a surface and an electrode in an electrolyte bath, wherein the electrolyte bath includes an aqueous electrolyte solution including sodium metabisulfite ($Na_2S_2O_5$), sodium molybdate ($Na_2MoO_4 \cdot 2H_2O$), a pH modifier, an anionic surfactant, and water;

applying a first pulsed direct current through the aqueous electrolyte solution using a direct current power supply, wherein the polarity of the first pulsed direct current causes the substrate to provide an anode and the electrode to provide a cathode; and forming a molybdenum disulfide ($MoS_2$) layer on the surface of the substrate.

2. The method of claim 1, further comprising applying the first pulsed direct current at a peak current density in the range of 5 milliamps per square centimeter (mA/cm^2) to 50 mA/cm^2 for a time period of 5 minutes to twenty minutes, wherein the pulses cycle in the range of 1 second to 4 second and have a duty cycle in the range of 25 percent to 50 percent of the cycle.

3. The method of claim 2, further comprising preparing the aqueous electrolyte solution by combining the sodium metabisulfite ($Na_2S_2O_5$) in the range of 5 percent and 15 percent by weight of the total weight of the aqueous electrolyte solution, the sodium molybdate ($Na_2MoO_4 \cdot 2H_2O$) in the range of 3 percent and 10 percent by weight of the total weight of the aqueous electrolyte solution, the pH modifier, and the anionic surfactant with the water.

4. The method of claim 3, further comprising combining the pH modifier to the aqueous electrolyte solution and adjusting the pH of the aqueous electrolyte solution to a pH in the range of 4.0 to 7.0.

5. The method of claim 4, further comprising combining citric acid as the pH modifier.

6. The method of claim 5, further comprising combining the anionic surfactant in the range of 5 percent and 15 percent by weight of the total weight of the aqueous electrolyte solution.

7. The method of claim 2, further comprising applying a second pulsed direct current through the aqueous electrolyte solution, wherein the polarity causes electrode to provide the anode and the substrate to provide the cathode; and forming a black oxide ($Fe_3O_4$) layer on the surface of the substrate prior to applying the first pulsed direct current.

8. The method of claim 7, wherein applying the second pulsed direct current comprises applying the second pulsed direct current at a peak current density in the range of 5 milliamps per square centimeter (mA/cm^2) to 25 mA/cm^2 for a time period of one minute to five minutes, wherein the pulses cycle in the range of 1 second to 4 seconds and have a duty cycle in the range of 25 percent to 50 percent of the cycle.

9. The method of claim 8, wherein the molybdenum disulfide ($MoS_2$) layer is in the range of 0.01 micrometer and 4 micrometers in thickness and the black oxide ($Fe_3O_4$) layer is in the range of 0.1 micrometer to 3 micrometers in thickness.

10. The method of claim 1, further comprising preparing the aqueous electrolyte solution by combining the sodium metabisulfite ($Na_2S_2O_5$) present in the range of 8 and 12 percent by weight of the total weight of the aqueous electrolyte solution, the sodium molybdate ($Na_2MoO_4 \cdot 2H_2O$) present in the range of 3 percent and 7 percent by weight of the total weight of the aqueous electrolyte solution, citric acid as the pH modifier present in the range of 1 percent and 3 percent by weight of the total weight of the aqueous electrolyte solution, TEEPOL 601 S as the anionic surfactant present in the range of 8 percent and 12 percent by weight of the total weight of the solution, and the water.

11. The method of claim 1, wherein immersing the substrate comprises immersing at least one surface of a bearing.

12. The method of claim 11, wherein the bearing is a ball bearing.

13. The method of claim 11, wherein the bearing is a journal bearing.

14. A method of coating a bearing surface with a lubricant coating, comprising:

immersing a bearing including a surface and an electrode in an electrolyte bath, wherein the electrolyte bath includes an aqueous electrolyte solution including sodium metabisulfite ($Na_2S_2O_5$), sodium molybdate ($Na_2MoO_4 \cdot 2H_2O$), a pH modifier, an anionic surfactant, and water;

applying a first pulsed direct current through the aqueous electrolyte solution using a direct current power supply, wherein the polarity of the current causes the bearing to provide an anode and the electrode to provide a cathode; and forming a molybdenum disulfide ($MoS_2$) layer on the surface of the bearing.

15. The method of claim 14, further comprising applying the first pulsed direct current at a peak current density in the range of 5 milliamps per square centimeter (mA/cm^2) to 50 mA/cm^2 for a time period of 5 minutes to twenty minutes, wherein the pulses cycle in the range of 1 second to 4 second and have a duty cycle in the range of 25 percent to 50 percent of the cycle.

16. The method of claim 14, further comprising applying a second pulsed direct current through the aqueous electrolyte solution, wherein the polarity causes electrode to provide the anode and the bearing to provide the cathode; and forming a black oxide ($Fe_3O_4$) layer on the surface of the bearing prior to applying the first pulsed direct current.

17. The method of claim 16, wherein applying the second pulsed direct current comprises applying the second pulsed direct current at a peak current density in the range of 5 milliamps per square centimeter (mA/cm^2) to 25 mA/cm^2 for a time period of 1 minute to five minutes, wherein the pulses cycle in the range of 1 second to 4 seconds and have a duty cycle in the range of 25 percent to 50 percent of the cycle.

18. The method of claim 14, further comprising preparing the aqueous electrolyte solution by combining the sodium metabisulfite ($Na_2S_2O_5$) present in the range of 5 percent and 15 percent by weight of the total weight of the aqueous electrolyte solution, the sodium molybdate ($Na_2MoO_4 \cdot 2H_2O$) present in the range of 3 percent and 10 percent by weight of the total weight of the aqueous electrolyte solution, citric acid as the pH modifier present in the range of 1 percent and 3 percent by weight of the total weight of the aqueous electrolyte solution, TEEPOL 601 S as the anionic surfactant present in the range of 5 percent and 15 percent by weight of the total weight of the solution, and the water.

19. A method of forming a lubricant coating, comprising:

preparing an aqueous electrolyte solution by combining a sodium metabisulfite ($Na_2S_2O_5$) present in the range of 5 and 15 percent by weight of the total weight of the aqueous electrolyte solution, a sodium molybdate ($Na_2MoO_4 \cdot 2H_2O$) present in the range of 3 percent and 10 percent by weight of the total weight of the aqueous electrolyte solution, citric acid present in the range of 1 percent and 3 percent by weight of the total weight of the aqueous electrolyte solution, an anionic surfactant present in the range of 5 percent and 15 percent by weight of the total weight of the solution, and water present in the range of 66 percent by weight to 80 percent by weight of the total weight of the solution, wherein the total weight of the solution is 100 percent weight;

immersing a substrate including a surface and an electrode in an electrolyte bath, including the aqueous electrolyte solution, wherein the electrode is an inert electrode material;

applying a first pulsed direct current through the aqueous electrolyte solution using a direct current power supply, wherein the polarity of the first pulsed direct current causes the substrate to provide an anode and the electrode to provide a cathode; and forming a molybdenum disulfide ($MoS_2$) layer on the surface of the substrate.

20. The method of claim 19, further comprising:

applying a second pulsed direct current through the aqueous electrolyte solution, wherein the polarity causes the electrode to provide the anode and the substrate to provide the cathode;

forming a black oxide ($Fe_3O_4$) layer on the surface of the substrate prior to applying the first pulsed direct current; and applying the first pulsed direct current at a peak current density in the range of 5 milliamps per square centimeter (mA/cm^2) to 50 mA/cm^2 for a time period of 5 minutes to twenty minutes, wherein the pulses cycle in the range of 1 second to 4 second and have a duty cycle in the range of 25 percent to 50 percent of the cycle.

* * * * *